US009142888B2

(12) United States Patent
Yukimoto et al.

(10) Patent No.: US 9,142,888 B2
(45) Date of Patent: Sep. 22, 2015

(54) ANTENNA-DEVICE SUBSTRATE AND ANTENNA DEVICE

(75) Inventors: Shinsuke Yukimoto, Saitama (JP); Ryo Saito, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 213 days.

(21) Appl. No.: 13/878,690

(22) PCT Filed: Oct. 13, 2011

(86) PCT No.: PCT/JP2011/005723

§ 371 (c)(1),
(2), (4) Date: Apr. 10, 2013

(87) PCT Pub. No.: WO2012/049847

PCT Pub. Date: Apr. 19, 2012

(65) Prior Publication Data

US 2013/0207858 A1 Aug. 15, 2013

(30) Foreign Application Priority Data

Oct. 15, 2010 (JP) ..... 2010-233129

(51) Int. Cl.
*H01Q 9/04* (2006.01)
*H01Q 1/24* (2006.01)
(Continued)

(52) U.S. Cl.
CPC ..... *H01Q 9/04* (2013.01); *H01Q 1/243* (2013.01); *H01Q 1/38* (2013.01); *H01Q 5/321* (2015.01); *H01Q 5/371* (2015.01); *H01Q 5/392* (2015.01); *H01Q 9/42* (2013.01); *H01Q 21/30* (2013.01)

(58) Field of Classification Search
CPC ..... H01Q 9/04; H01Q 21/30; H01Q 1/38; H01Q 1/24
USPC ..... 343/749, 702, 700 MS, 767
See application file for complete search history.

(56) References Cited

U.S. PATENT DOCUMENTS 4,924,237 A * 5/1990 Honda et al. ..... 343/702
5,936,583 A * 8/1999 Sekine et al. ..... 343/702
(Continued)

FOREIGN PATENT DOCUMENTS

JP 2010103841 A 5/2010
WO WO-2008117558 A1 10/2008

OTHER PUBLICATIONS

International Search Report of PCT/JP2011/005723.

*Primary Examiner* — Huedung Mancuso
(74) *Attorney, Agent, or Firm* — Locke Lord LLP; Jeffrey D. Hsi

(57) ABSTRACT

Provided is an antenna-device substrate which is capable of flexibly adjusting multiple resonance frequencies, and also provided is an antenna device. The antenna-device substrate is provided with a substrate main body (2), a ground plane (GND) on the surface of the substrate main body (2), first to third elements (1 to 5), and a short part (6) connecting the first element (3) and the second element (4). The first element is provided with a feed point (FP) at the base end and extends comprising a first connector (C1) of a first passive element (P1). The second element is connected to the ground plane and is provided with a first antenna element (AT1) at the tip end, and extends comprising a second connector (C2) of a second passive element (P2) and comprising a fourth passive element (P4). The third element extends comprising a third connector (C3) of a third passive element (P3). The first element extends with a gap provided between the first element and each of the second element, the third element, and the ground plane such that a floating capacitance can be generated therebetween.

9 Claims, 6 Drawing Sheets

(51) Int. Cl.

| | |
|---|---|
| ***H01Q 1/38*** | (2006.01) |
| ***H01Q 9/42*** | (2006.01) |
| ***H01Q 21/30*** | (2006.01) |
| ***H01Q 5/321*** | (2015.01) |
| ***H01Q 5/371*** | (2015.01) |
| ***H01Q 5/392*** | (2015.01) |

(56) References Cited

U.S. PATENT DOCUMENTS

| | | | | |
|---|---|---|---|---|
| 7,109,928 | B1 * | 9/2006 | Thiele et al. | 343/700 MS |
| 2004/0145525 | A1 * | 7/2004 | Annabi et al. | 343/700 MS |
| 2008/0180339 | A1 * | 7/2008 | Yagi | 343/767 |

* cited by examiner

ANTENNA-DEVICE SUBSTRATE AND ANTENNA DEVICE

CROSS-REFERENCE TO RELATED APPLICATIONS

This application is the national phase under 35 U.S.C. §371 of PCT International Application No. PCT/US2011/005723, filed Oct. 13, 2011, which claims the benefit of Japanese Patent Application No. 2010-233129, filed Oct. 15, 2010, the entire contents of the aforementioned applications are hereby incorporated herein by reference.

BACKGROUND OF THE INVENTION

1. Field of the Invention

The present invention relates to an antenna-device substrate which is capable of supporting multiple resonance frequencies and an antenna device provided with the same.

2. Description of the Related Art

Conventionally, in order to multiple-resonate the resonance frequency of an antenna provided in communication equipment, there has been proposed an antenna including a radiation electrode and a dielectric block or an antenna device using a switch and a controlled voltage source.

For example, as a conventional technique using a dielectric block, Patent Document 1 discloses a high-efficiency composite antenna which is obtained by forming a radiation electrode into a molded resin article and then integrating the molded resin article and a dielectric block with an adhesive.

Also, as a conventional technique using a switch and a controlled voltage source, Patent Document 2 discloses an antenna device including a first radiation electrode, a second radiation electrode, and a switch which is interposed between the middle part of the first radiation electrode and the base end part of the second radiation electrode and electrically connects or disconnects the second radiation electrode to/from the first radiation electrode.

PRIOR ART DOCUMENTS

Patent Documents

Patent Document 1: Japanese Laid-Open Patent Publication No. 2010-81000

Patent Document 2: Japanese Laid-Open Patent Publication No. 2010-166287

SUMMARY OF THE INVENTION

Problems to be Solved by the Invention

However, the following problems still remain in the conventional techniques described above.

Specifically, in the technique using a dielectric block as disclosed in Patent Document 1, a dielectric block for exciting a radiation electrode is used so that the dielectric block, the radiation electrode pattern, and the like need to be designed for each equipment, resulting in a disadvantage in that the antenna performance may be deteriorated depending on the design conditions or the unstable factors may increase. Also, since a radiation electrode is formed on the surface of a molded resin article, a radiation electrode pattern needs to be designed on the molded resin article. Consequently, antenna design and die design are required depending on communication equipment for implementation or its application, resulting in a considerable increase in cost. Furthermore, a dielectric block and a molded resin article are integrated with an adhesive, resulting in deterioration of the antenna performance or an undesirable increase in the unstable factors depending on adhesion conditions (thickness of adhesive, adhesive area, and the like) other than the Q value of adhesive.

In the case of an antenna device using a switch and a controlled voltage source as disclosed in Patent Document 2, the resonance frequency is switched by the switch so that the configuration of a controlled voltage source, a reactance circuit, and the like are required, resulting in a complication of the antenna configuration for each equipment, no degree of freedom in design, and a difficulty in readily adjustment the antenna.

The present invention has been made in view of the aforementioned circumstances, and an object of the present invention is to provide an antenna-device substrate and an antenna device which are capable of flexibly adjusting multiple resonance frequencies and are also capable of achieving a size reduction and thinning as well as readily ensuring the antenna performance at low cost depending on its application for each equipment.

Means for Solving the Problems

The present invention adopts the following structure in order to solve the aforementioned problems. Specifically, the antenna-device substrate of the present invention is characterized in that it includes an insulating substrate main body; a ground plane, a first element, a second element, and a third element each of which is in the form of metal foil and has been patterned on the surface of the substrate main body; and a short part connecting a part of the first element and a part of the second element, wherein the first element is provided with a feed point at the base end and extends comprising a first connector of which the intermediate part is connectable to a first passive element, the second element is connected to the ground plane at the base end and is provided with a first antenna element of a dielectric antenna at the tip end, and extends comprising a second connector to which a second passive element is connectable and a fourth passive element connected closer to the ground plane side than the second connector, the third element extends comprising a third connector to which a third passive element is connectable and the base end of the third element is connected closer to the base end side than the first connector of the first element, the short part is connected between the position closer to the base end side than the first connector of the first element and the portion from the second connector to the fourth passive element of the second element, and the first element extends with a gap provided between the first element and each of the second element, the third element, and the ground plane such that a floating capacitance can be generated between the first element and each of the second element, the third element, and the ground plane.

In the antenna-device substrate, since the first element extends with a gap provided between the first element and each of the second element, the third element, and the ground plane such that a floating capacitance can be generated between the first element and the second element having the first antenna element, between the first element and the third element, and between the first element and the ground plane, the antenna-device substrate can be provided with a multiple resonance (a double resonance or a triple resonance) characteristic by effectively utilizing a floating capacitance between the first antenna element serving as a loading element which is not self-resonant to a desired resonance frequency and each element. By selecting the first antenna element and the first to third passive elements which make connection to the first to third connectors, an antenna device which is capable of flexibly adjusting resonance frequencies and achieving a double resonance or a triple resonance characteristic depending on design conditions can be obtained. As described above, resonance frequencies can be flexibly adjusted by one antenna-device substrate for reasons of antenna configuration, and thus, the resonance frequency can be switched. Consequently, places where adjustment is required by the passive elements or the like can be changed depending on application or equipment. Note that a bandwidth can be adjusted by setting the lengths and widths of the elements and the floating capacitances.

Design can be made within the plane of the substrate main body so that thinning of the substrate main body can be achieved as compared with the case where a conventional dielectric block, molded resin article, or the like is used. In addition, a size reduction and enhanced performance can be achieved by selecting the first antenna element serving as a dielectric antenna. Furthermore, no additional cost is incurred due to change in die and design, resulting in realization of a low cost product.

Also, the antenna-device substrate of the present invention is characterized in that the first element includes a first extension portion extending from the feed point provided on the ground plane side to a direction away from the ground plane, a second extension portion extending from the tip end of the first extension portion to the short part which extends in a direction along the ground plane, a third extension portion extending from the tip end of the second extension portion to a direction along the ground plane, a fourth extension portion extending from the tip end of the third extension portion toward the ground plane, and a fifth extension portion extending from the tip end of the fourth extension portion toward the first extension portion along the ground plane, the second element includes a sixth extension portion extending from the short part to the base end side and a seventh extension portion extending from the short part to the tip end side and the tip end side of the second element is arranged along a space between the third extension portion and the fifth extension portion, and the third element includes an eighth extension portion extending from the first extension portion in the same direction as the first extension portion and a ninth extension portion extending from the eighth extension portion along the second extension portion.

Specifically, in the antenna-device substrate, since the second element comprises the sixth extension portion extending from the short part to the base end side and the seventh extension portion extending from the short part to the tip end side and the tip end side of the second element is arranged along a space between the third extension portion and the fifth extension portion and the third element comprises the eighth extension portion extending from the first extension portion in the same direction as the first extension portion and the ninth extension portion extending from the eighth extension portion along the second extension portion, a floating capacitance between the first antenna element and the fifth extension portion, a floating capacitance between the first antenna element and the fourth extension portion, a floating capacitance between the first antenna element and the third extension portion, a floating capacitance between the fifth extension portion and the ground plane, a floating capacitance between the second extension portion and the sixth extension portion, a floating capacitance between the tip end of the third element and the third extension portion, and a floating capacitance between the ninth extension portion and the second extension portion can be generated, resulting in obtaining a high degree of freedom in adjustment resonance frequencies.

Furthermore, the antenna-device substrate of the present invention is characterized in that a position at which the short part is connected is changeable in an extending direction between the second extension portion and the tip end side of the second element which are parallel to one another.

Specifically, in the antenna-device substrate, since a position at which the short part is connected is changeable in an extending direction between the second extension portion and the tip end side of the second element which are parallel to one another, the length between the second extension portion and the sixth extension portion is changed by changing a position at which the short part is connected so that a resonance frequency can be adjusted. In addition, a floating capacitance between the third extension portion and the seventh extension portion can also be adjusted, resulting in adjustment of impedance. Thus, a frequency can be flexibly adjusted by changing the position of the short part.

Also, the antenna-device substrate of the present invention is characterized in that the third extension portion provided in the first element includes a wide portion which is formed facing to the tip end of the third element such that a floating capacitance can be generated therebetween.

Specifically, in the antenna-device substrate, since the third extension portion provided in the first element includes a wide portion which is formed facing to the tip end of the third element such that a floating capacitance can be generated therebetween, a floating capacitance between the tip end of the third element and the wide portion can be readily set. In addition, the effective area of the entire antenna increases, resulting in achieving broadband and high gain features.

Also, the antenna-device substrate of the present invention is characterized in that the second antenna element of the dielectric antenna is provided at the tip end of the third element.

Specifically, in the antenna-device substrate, since the second antenna element of the dielectric antenna is provided at the tip end of the third element, the length of the tip end of the third element can be shortened by the second antenna element so that the entire antenna installation area can be further reduced.

Also, when the wide portion is employed, the antenna-device substrate is readily affected by a floating capacitance between the tip end of the third element and the wide portion, resulting in achieving broadband and high gain features.

The antenna device of the present invention is characterized in that it includes the antenna-device substrate of the present invention described above, wherein the first passive element, the second passive element, and the third passive element are connected to the first connector, the second connector, and the third connector corresponding thereto respectively.

Specifically, since the antenna device includes the antenna-device substrate of the present invention described above and the first passive element, the second passive element, and the third passive element are connected to the first connector, the second connector, and the third connector corresponding thereto respectively, the antenna device can be provided with a double resonance or triple resonance characteristic by appropriately selecting the first to third passive elements so that communication can be established using two or three resonance frequencies corresponding to each application or each equipment.

Also, the antenna device of the present invention is characterized in that it includes the antenna-device substrate of the present invention described above, wherein the second passive element is connected to the second connector, and either one of the first passive element or the third passive element is connected to the first connector or the third connector corresponding thereto respectively.

Specifically, in the antenna device, since the second passive element is connected to the second connector, and either one of the first passive element or the third passive element is connected to the first connector or the third connector corresponding thereto respectively, two types of double resonance can be made without utilizing the first passive element or the second passive element.

Effects of the Invention

According to the present invention, the following effects may be provided.

According to the antenna-device substrate of the present invention and the antenna device provided with the same, since the first element extends with a gap provided between the first element and each of the second element, the third element, and the ground plane such that a floating capacitance can be generated between the first element and the second element having the first antenna element, between the first element and the third element, and between the first element and the ground plane, the antenna-device substrate can be provided with a multiple resonance (a double resonance or a triple resonance) characteristic. Also, by selecting the first antenna element and the first to third passive elements which make connection to the first to third connectors, an antenna device which is capable of flexibly adjusting resonance frequencies and achieving a double resonance or a triple resonance characteristic depending on design conditions can be obtained and a size reduction and enhanced performance can also be achieved.

Thus, the antenna-device substrate of the present invention and the antenna device provided with the same can be readily provided with a multiple resonance characteristic corresponding to a wide variety of applications or a wide variety of equipment, resulting in a reduction in space requirements.

BEST MODES FOR CARING OUT THE INVENTION

Figure 1:
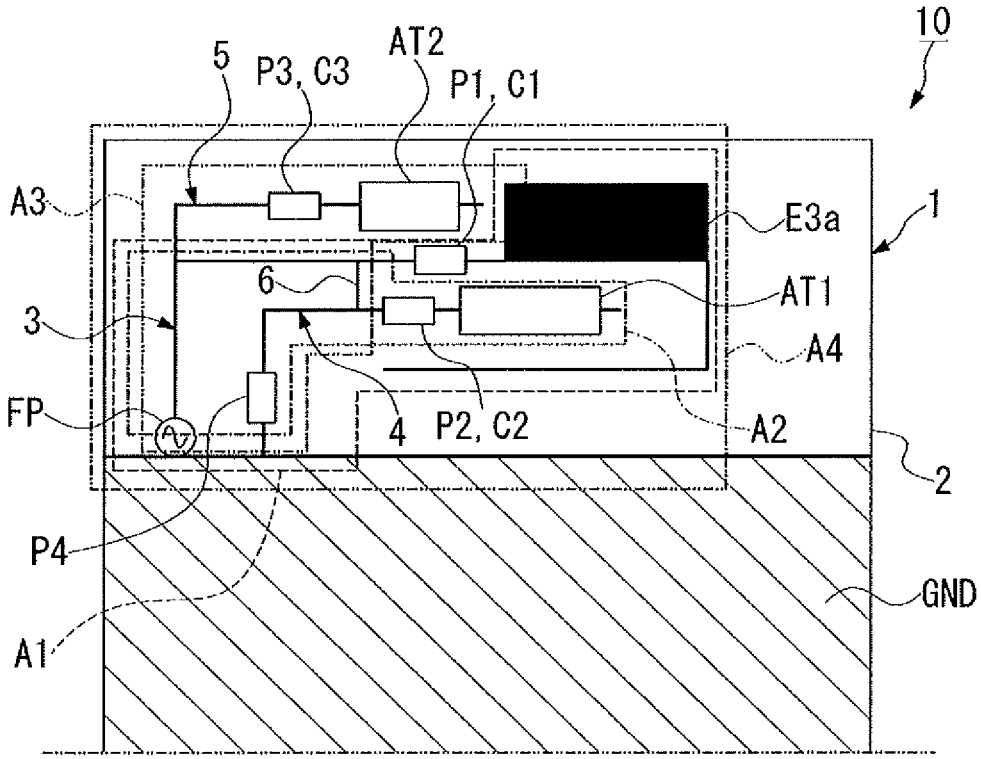
FIG. 1 is a plan view illustrating an antenna-device substrate and an antenna device according to one embodiment of the antenna-device substrate and the antenna device of the present invention.

Hereinafter, a description will be given of an antenna-device substrate and an antenna device provided with the same according to one embodiment of the present invention with reference to FIGS. 1 to 7, As shown in FIG. 1, an antenna-device substrate 1 of the present embodiment includes an insulating substrate main body 2; a ground plane (GND), a first element 3, a second element 4, and a third element 5 each of which is in the form of metal foil and has been patterned on the surface of the substrate main body 2; and a short part 6 connecting a part of the first element 3 and a part of the second element 4.

The substrate main body 2 is a typical printed curcuit board. In the present embodiment, the main body of a printed circuit board consisting of a rectangular glass epoxy resin or the like is employed as the substrate main body 2.

The first element 3 is provided with a feed point (FP) at the base end and extends comprising a first connector (C1) which is connectable to a first passive element (P1) at the intermediate part of the first element 3. Note that the feed point (FP) is connected to a high-frequency circuit (not shown) provided on the ground plane (GND) side of the substrate main body 2.

The second element 4 is connected to the ground plane (GND) at the base end and is provided with a first antenna element (AT1) of a dielectric antenna at the tip end, and extends comprising a second connector (C2) to which a second passive element (P2) is connectable and comprising a fourth passive element (P4) connected closer to the ground plane side than the second connector (C2).

The third element 5 extends comprising a third connector (C3), to which a third passive element (P3) is connectable, provided closer to the base end side than the second antenna element (AT2), wherein the base end of the third element 5 is connected closer to the base end side than the first connector (C1) of the first element 3 and a second antenna element (AT2) of the dielectric antenna is provided at the tip end of the third element 5.

Figure 3:
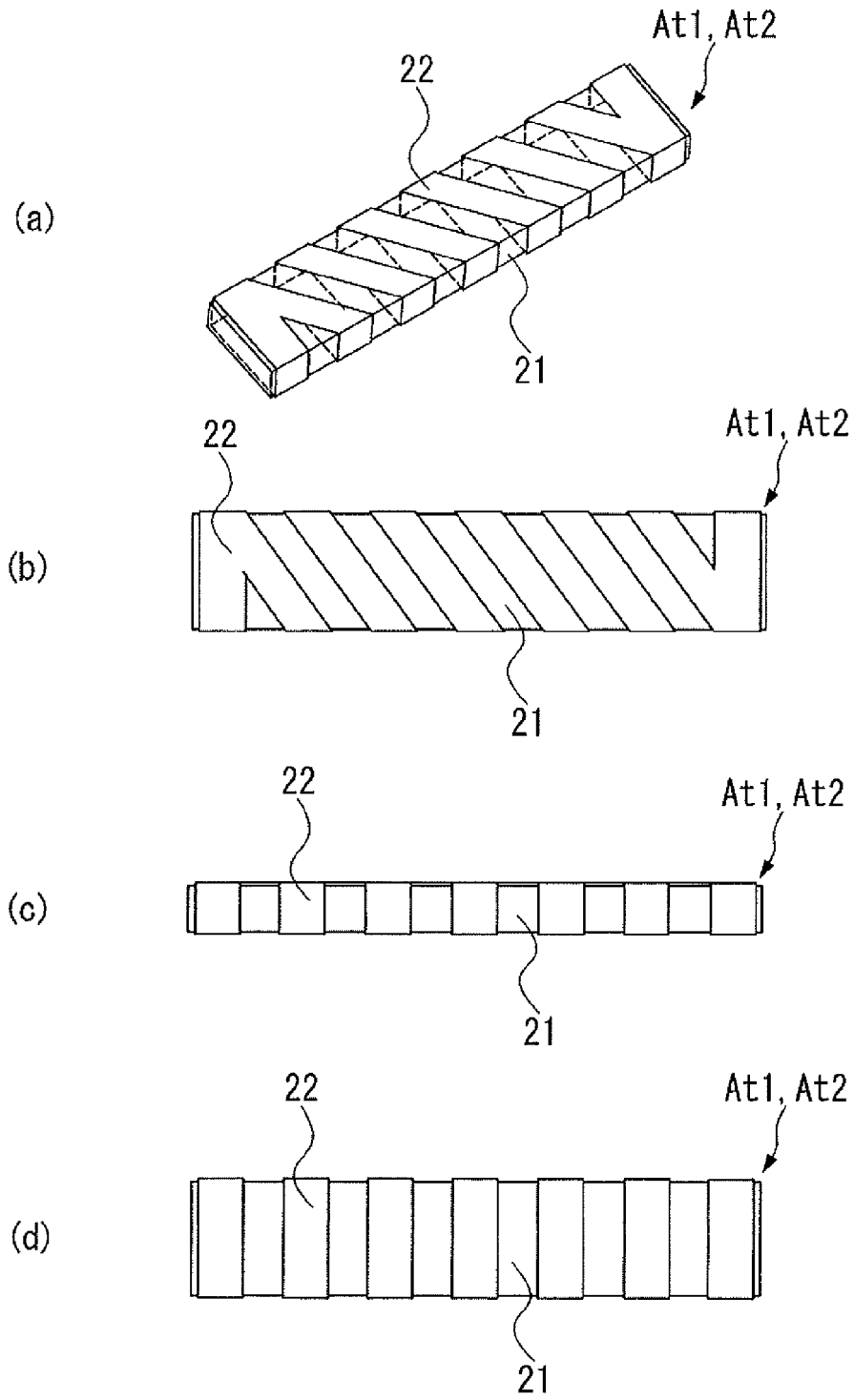
FIG. 3*a* is a perspective view illustrating a first antenna element and a second antenna element according to the present embodiment.
FIG. 3*b* is a plan view illustrating a first antenna element and a second antenna element according to the present embodiment.
FIG. 3*c* is a front view illustrating a first antenna element and a second antenna element according to the present embodiment.
FIG. 3*d* is a bottom view illustrating a first antenna element and a second antenna element according to the present embodiment.

Each of the first antenna element (AT1) and the second antenna element (AT2) is a loading element which is not self-resonant to a desired resonance frequency and is, for example as shown in FIG. 3, a chip antenna in which a conductor pattern 22 such as Ag or the like is formed on the surface of a dielectric 21 such as ceramics or the like. For these first antenna element (AT1) and second antenna element (AT2), elements having a different length, width, conductor pattern 22, or the like may be selected or the same elements may also be selected depending on the settings of resonance frequency or the like.

The short part 6 is connected between the position closer to the base end side than the first connector (C1) of the first element 3 and the position from the second connector (C2) to the fourth passive element (P4) of the second element 4.

Figure 2:
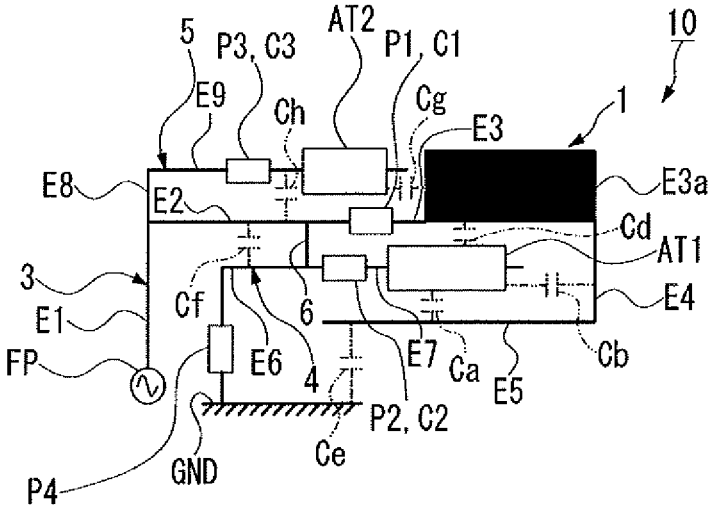
FIG. 2 is a wiring diagram illustrating a floating capacitance generated by an antenna-device substrate and an antenna device according to the present embodiment.

As shown in FIG. 2, the first element 3 includes a first extension portion (E1) extending from the feed point (FP) provided on the ground plane (GND) side to a direction away from the ground plane (GND), a second extension portion (E2) extending from the tip end of the first extension portion (E1) to the short part 6 which extends in a direction along the ground plane (GND), a third extension portion (E3) extending from the tip end of the second extension portion (E2) to a direction along the ground plane (GND), a fourth extension portion (E4) extending from the tip end of the third extension portion (E3) toward the ground plane (GND), and a fifth extension portion (E5) extending from the tip end of the fourth extension portion (E4) toward the first extension portion (E1) along the ground plane (GND).

Also, the tip end side of the second element 4 is arranged along a space between the third extension portion (E3) and the fifth extension portion (E5). The second element 4 includes a sixth extension portion (E6) extending from the short part 6 to the base end side and a seventh extension portion (E7) extending from the short part 6 to the tip end side. At the tip end of the seventh extension portion (E7), the first antenna element (AT1) is provided longitudinal to the seventh extension portion (E7) in the extending direction thereof.

Furthermore, the third element 5 includes an eighth extension portion (E8) extending from the first extension portion (E1) in the same direction as the first extension portion (E1) and a ninth extension portion (E9) extending from the eighth extension portion (E8) along the second extension portion (E2). At the tip end of the ninth extension portion (E9), the second antenna element (AT2) is provided longitudinal to the ninth extension portion (E9) in the extending direction thereof.

Also, the third extension portion (E3) provided in the first element 3 includes a wide portion (E3*a*) which is formed facing to the tip end of the third element 5, i.e., the second antenna element (AT2) such that a floating capacitance can be generated the wide portion (E3*a*) and the second antenna element (AT2). The wide portion (E3*a*) is in a rectangular shape of which the line width is wide as compared with that of other portions of the second extension portion (E2) and the third extension portion (E3), the side at the base end side of the wide portion (E3*a*) is arranged facing the side at the tip end side of the second antenna element (AT2).

Figure 4:
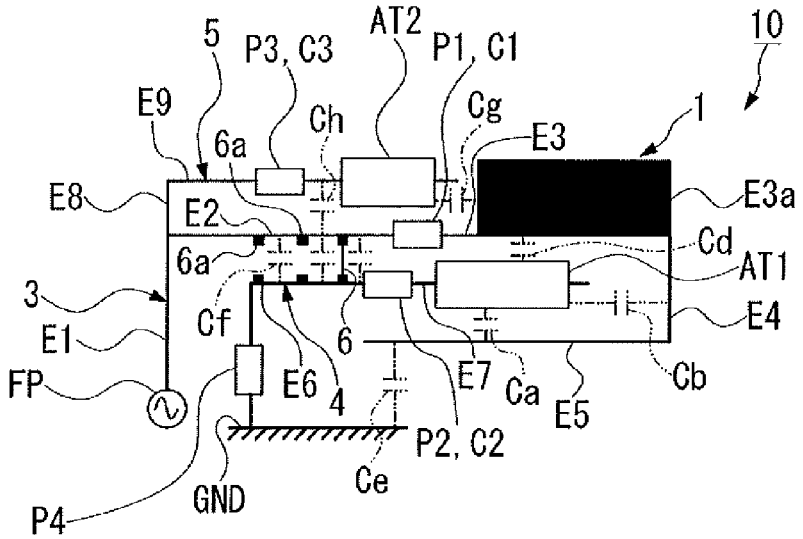
FIG. 4 is a wiring diagram illustrating a change in position of a short part according to the present embodiment.

As shown in FIG. 4, a position at which the short part 6 is connected is changeable in an extending direction between the second extension portion (E2) and the tip end side of the second element 4 which are parallel to one another. Specifically, a plurality of electrode pads 6*a* is provided in a line along the extending direction of the second extension portion (E2) and along the extending direction of the extension portion at the tip end side of the second element 4. By selecting the electrode pads 6*a* to be connected, a jumper resistance is provided between the electrode pads 6*a* for connection.

When adjustment by the short part 6 becomes unnecessary, a short part may also be a short pattern formed by a patterned metal foil by pre-fixing its connection position as in other elements.

The first element 3 extends with a gap provided between the first element 3 and each of the second element 4, the third element 5, and the ground plane (GND) such that a floating capacitance can be generated between the first element 3 and the second element 4, between the first element 3 and the third element 5, and between the first element 3 and the ground plane (GND).

Specifically, as shown in FIG. 2, a floating capacitance (Ca) between the first antenna element (AT1) and the fifth extension portion (E5), a floating capacitance (Cb) between the first antenna element (AT1) and the fourth extension portion (E4), a floating capacitance (Cd) between the first antenna element (AT1) and the third extension portion (E3), a floating capacitance (Ce) between the fifth extension portion (E5) and the ground plane (GND), a floating capacitance (Cf) between the second extension portion (E2) and the sixth extension portion (E6), a floating capacitance (Cg) between the second antenna element (AT2) (the tip end of the third element 5) and the third extension portion (E3) (including the wide portion (E3*a*)), and a floating capacitance (Ch) between the ninth extension portion (E9) and the second extension portion (E2) can be generated.

As the first passive element (P1), the second passive element (P2), the third passive element (P3), and the fourth passive element (P4), an inductor, a capacitor, or a resistor may be employed.

As shown in FIG. 1, an antenna device 10 of the present embodiment includes the antenna-device substrate 1. The first passive element (P1), the second passive element (P2), and the third passive element (P3) are connected to the first connector (C1), the second connector (C2), and the third connector (C3) corresponding thereto respectively.

Next, a description will be given of a resonance frequency in the antenna device of the present embodiment with reference to FIG. 5.

Figure 5:
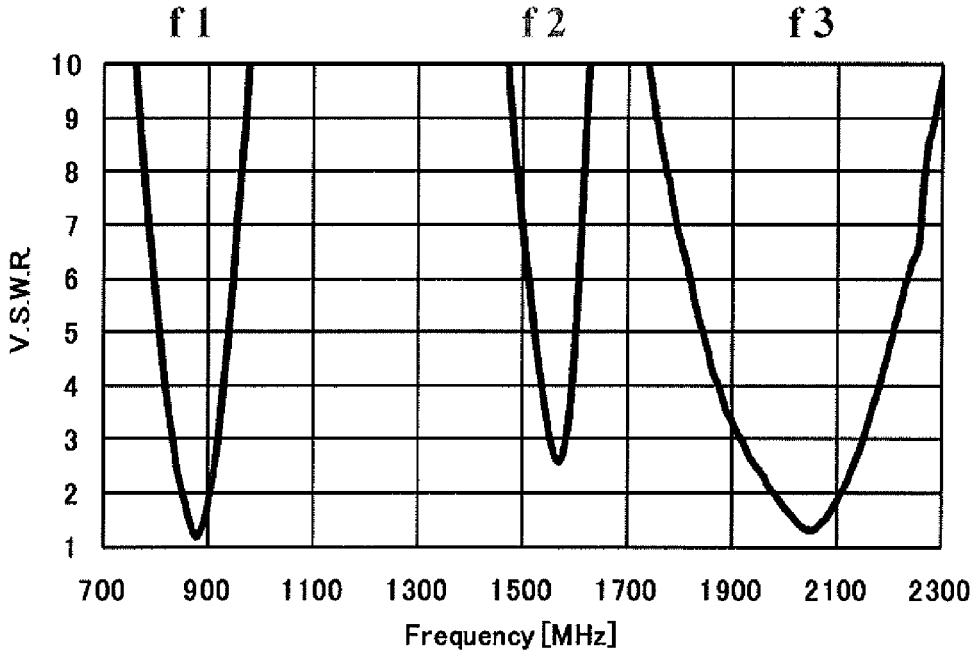
FIG. 5 is a graph illustrating VSWR properties (voltage standing wave ratio) of triple resonance frequencies according to the present embodiment.

As shown in FIG. 5, the antenna device of the present embodiment has multiple resonance frequencies at three frequencies, i.e., a first resonance frequency (f1), a second resonance frequency (f2), and a third resonance frequency (f3).

The first resonance frequency (f1) is in a low frequency band among three resonance frequencies, and is determined by the first element 3, the first passive element (P1), and the floating capacitance. The second resonance frequency (f2) is in a middle frequency band among three resonance frequencies, and is determined by the first antenna element (AT1), the second passive element (P2), and the floating capacitance. Furthermore, the third resonance frequency (f3) is in a high frequency band among three resonance frequencies, and is determined by the second antenna element (AT2), the third passive element (P3), and the floating capacitance. For the resonance frequencies, the flow of high-frequency current to the ground plane (GND) side is controlled by using the fourth passive element (P4) to thereby perform final impedance adjustment.

Hereinafter, a detailed description will be given of these resonance frequencies.

(First Resonance Frequency (f1))

The frequency of the first resonance frequency (f1) can be set and adjusted by the lengths of the third extension portion (E3) including the wide portion (E3*a*), the fourth extension portion (E4), and the fifth extension portion (E5) and the position of the short part 6.

Also, the widening of the first resonance frequency (f1) can be set by the lengths and widths of the third extension portion (E3) including the wide portion (E3*a*), the fourth extension portion (E4), and the fifth extension portion (E5).

The impedance of the first resonance frequency (f1) can be adjusted by setting floating capacitances that are the floating capacitance (Ca), the floating capacitance (Cb), the floating capacitance (Cd), the floating capacitance (Ce), and the floating capacitance (Cf).

Furthermore, final frequency adjustment can be flexibly made by selecting the first passive element (P1).

Final impedance adjustment can also be flexibly made by selecting the fourth passive element (P4).

As described above, the resonance frequency, and the bandwidth and the impedance thereof can be flexibly adjusted by use of "the lengths and widths of elements", "the passive elements", and "the floating capacitance between the first antenna element (AT1) and each element". Specifically, the first resonance frequency (f1) is mainly adjusted by a portion shown by the broken lines A1 in FIG. 1.

The length of each of the second extension portion (E2) and the sixth extension portion (E6) is adjusted by adjusting the position of the short part 6 so that the resonance frequency can be adjusted. Also, the floating capacitance (Cf) is adjusted by adjusting the position of the short part 6 so that the impedance can be adjusted.

(Second Resonance Frequency (f2))

The frequency of the second resonance frequency (f2) can be set and adjusted by the first antenna element (AT1), the second element 4 provided closer to the tip end side than the short part 6, and the position of the short part 6.

Also, the widening of the second resonance frequency (f2) can be set by the lengths and widths of the sixth extension portion (E6) and the second extension portion (E2).

Also, the impedance of the second resonance frequency (f2) can be adjusted by setting floating capacitances that are the floating capacitance (Ca), the floating capacitance (Cb), the floating capacitance (Cd), the floating capacitance (Ce), and the floating capacitance (Cf).

Furthermore, final frequency adjustment can be flexibly made by selecting the second passive element (P2).

Final impedance adjustment can also be flexibly made by selecting the fourth passive element (P4).

As described above, the resonance frequency, the bandwidth, and the impedance thereof can be flexibly adjusted by use of "the first antenna element (AT1)", "the passive elements", and "the floating capacitance between the first antenna element (AT1) and each element". Specifically, the second resonance frequency (f2) is mainly adjusted by a portion encircled by a dot-dash line A2 shown in FIG. 1.

(Third Resonance Frequency (f3))

The frequency of the third resonance frequency (f3) can be set and adjusted by the second antenna element (AT2), the third element 5, and the position of the short part 6.

Also, the widening of the third resonance frequency (f3) can be set by the length and width of the third element 5 and the floating capacitance (Cg).

Also, the impedance of the third resonance frequency (f3) can be adjusted by setting floating capacitances that are the floating capacitance (Cf), the floating capacitance (Cg), and the floating capacitance (Ch).

Furthermore, final frequency adjustment can be flexibly made by selecting the third passive element (P3), Final impedance adjustment can also be flexibly made by selecting the fourth passive element (P4).

As described above, the resonance frequency, the bandwidth, and the impedance thereof can be flexibly adjusted by use of "the second antenna element (AT2)", "the passive elements", and "the floating capacitance between the second antenna element (AT2) and each element". Specifically, the third resonance frequency (f3) is mainly adjusted by a portion encircled by a dashed-two dotted line A3 shown in FIG. 1.

It is desirable that the antenna occupied area (the installation area permitted to the antenna device 10) A4 be as large as possible in terms of antenna characteristics. It is preferable that the other configuration is set to the following conditions.

Specifically, it is desirable that the distance between the ground plane (GND) and the upper end (ninth extension portion) of the antenna-device substrate 1 be set as long as possible in terms of floating capacitance.

It is also desirable that the width of the antenna size (the distance between the outer edge of the eighth extension portion (E8) and the outer edge of the fourth extension portion (E4)) be as wide as possible in terms of floating capacitance.

It is also desirable that the distance between the ground plane (GND) and the fifth extension portion (E5) be as long as possible.

For reasons of readily adjustment as a pattern, it is also desirable that the width of the fourth extension portion (E4) be as wide as possible and the length and width of the wide portion (E3*a*) be as long as and as wide as possible.

It is also desirable that the length and width of each of the sixth extension portion (E6) and the seventh extension portion (E7) be as long as and as wide as possible.

Note that it is preferable that the size of the substrate main body 2 in a direction along the first extension portion (E1) be a length of about ¼ of the wavelength to be used.

In the antenna device 10 of the present embodiment, a resonance frequency can be switched while taking into account influences around the antenna (antenna peripheral components, human bodies, and the like). Specifically, the first antenna element (AT1) is less affected by influences around the antenna due to influences of a floating capacitance between the first antenna element (AT1) and each of the first element 3 to the third element 5, whereas the second antenna element (AT2) is likely to be affected by influences around the antenna because the second antenna element (AT2) is designed to match the outer periphery of the entire antenna.

In view of the above, the adjustment location of the second resonance frequency (f2) and the adjustment location of the third resonance frequency (f3) can be flexibly changed by changing the selection and settings of the first antenna element (AT1), the second antenna element (AT2), and the passive elements depending on the application. Specifically, the third resonance frequency (f3) can be adjusted by a portion encircled by the dot-dash line A2 and the second resonance frequency (f2) can also be adjusted by a portion encircled by the dashed-two dotted line A3 by switching the portion encircled by the dot-dash line A2 for adjusting the second resonance frequency (f2) and the portion encircled by the dashed-two dotted line A3 for adjusting the third resonance frequency (f3).

Also, the antenna-device substrate 1 and the antenna device 10 of the present embodiment can be provided with not only a triple resonance described above but also a double resonance. For example, there may be a case where the antenna device 10 of the present embodiment is used for the device of the same type and uses a double resonance at a current stage but uses a triple resonance at a future stage. Also in such a case, the antenna-device substrate 1 can be provided with a double resonance and a triple resonance as it is.

Figure 6:
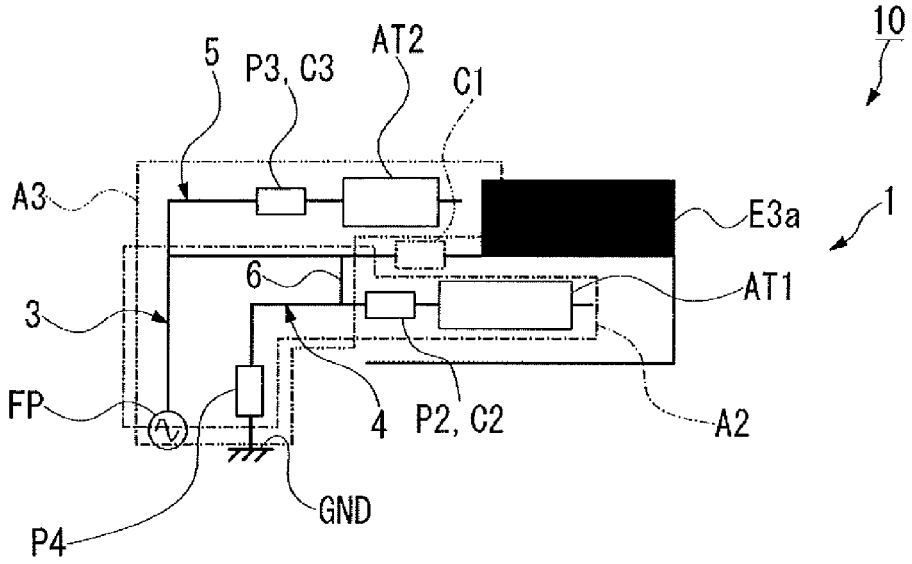
FIG. 6 is a wiring diagram illustrating an antenna device having double resonance frequencies without using a first passive element according to the present embodiment.
Figure 7:
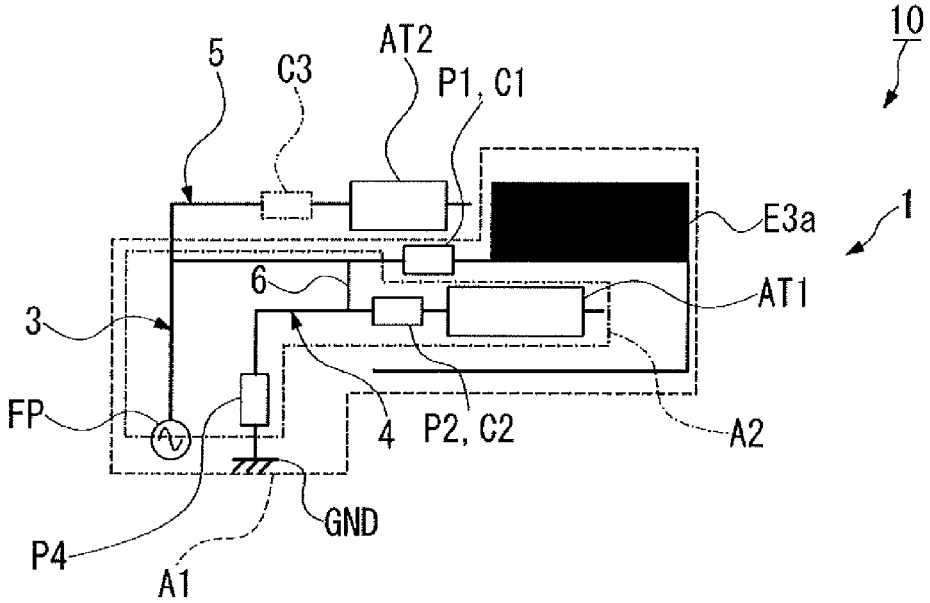
FIG. 7 is a wiring diagram illustrating an antenna device having double resonance frequencies without using a third passive element according to the present embodiment.

As the method for achieving a double resonance, there are two types of corresponding methods: a method for not using the first passive element (P1) as shown in FIG. 6 and a method for not using the third passive element (P3) as shown in FIG. 7, the third passive element (P3). Since the frequency band in this case can be individually adjusted as described above, the frequency band can be flexibly designed to a desired frequency band.

As described above, in the antenna-device substrate 1 and the antenna device 10 of the present embodiment, since the first element 3 extends with a gap provided between the first element 3 and each of the second element 4, the third element 5, and the ground plane (GND) such that a floating capacitance can be generated between the first element 3 and the second element 4 having the first antenna element (AT1), between the first element 3 and the third element 5 having the second antenna element (AT2), and between the first element 3 and the ground plane (GND), the antenna-device substrate 1 and the antenna device 10 can be provided with a multiple resonance (a double resonance or a triple resonance) characteristic by effectively utilizing a floating capacitance between each antenna element serving as a loading element which is not self-resonant to a desired resonance frequency and each element.

Also, by selecting (changing the constant thereof or the like) the first antenna element (AT1), the second antenna element (AT2), and the first to third passive elements P1 to P3 which make connection to the first to third connectors C1 to C3, the antenna device 10 which is capable of flexibly adjusting resonance frequencies and achieving a double resonance or a triple resonance characteristic depending on design conditions can be obtained. As described above, resonance frequencies can be flexibly adjusted by one antenna-device substrate 1 for reasons of antenna configuration, and thus, the resonance frequency can be switched. Consequently, places where adjustment is required by the passive elements or the like can be changed depending on application or equipment.

Also, design can be made within the plane of the substrate main body 2 so that thinning of the substrate main body 2 can be achieved as compared with the case where a conventional dielectric block, molded resin article, or the like is used. In addition, a size reduction and enhanced performance can be achieved by selecting two antenna elements, i.e., the first antenna element (AT1) and the second antenna element (AT2). Furthermore, no additional cost is incurred due to change in die and design, resulting in realization of a low cost product.

Furthermore, since a position at which the short part 6 is connected is changeable in an extending direction between the second extension portion (E2) and the sixth extension portion (E6) which are parallel to one another, the length between the second extension portion (E2) and the sixth extension portion (E6) is changed by changing the position at which the short part 6 is connected so that a resonance frequency can be adjusted. In addition, a floating capacitance between the third extension portion (E3) and the seventh extension portion (E7) can also be adjusted, resulting in adjustment of impedance. Thus, a frequency can be flexibly adjusted by changing the position of the short part 6.

Also, since the third extension portion (E3) provided in the first element 3 includes the wide portion (E3*a*) which is formed facing to the tip end of the third element 5 (the second antenna element (AT2)) such that a floating capacitance can be generated therebetween, a floating capacitance between the tip end of the third element 5 and the wide portion (E3*a*) can be readily set. In addition, the effective area of the entire antenna increases, resulting in achieving broadband and high gain features.

Thus, since the antenna device 10 of the present embodiment includes the antenna-device substrate 1 and the first passive element (P1), the second passive element (P2), and the third passive element (P3) are connected to the first connector (C1), the second connector (C2), and the third connector (C3) corresponding thereto respectively, the antenna device 10 can be provided with a double resonance or triple resonance characteristic by appropriately selecting the first to third passive elements P1 to P3 so that communication can be established using two or three resonance frequencies corresponding to each application or each equipment.

Also, since the second passive element (P2) is connected to the second connector (C2), and either one of the first passive element (P1) or the third passive element (P3) is connected to the first connector (C1) or the third connector (C3) corresponding thereto respectively, two types of double resonance can be made without utilizing the first passive element (P1) or the second passive element (22).

EXAMPLES

Figure 8:
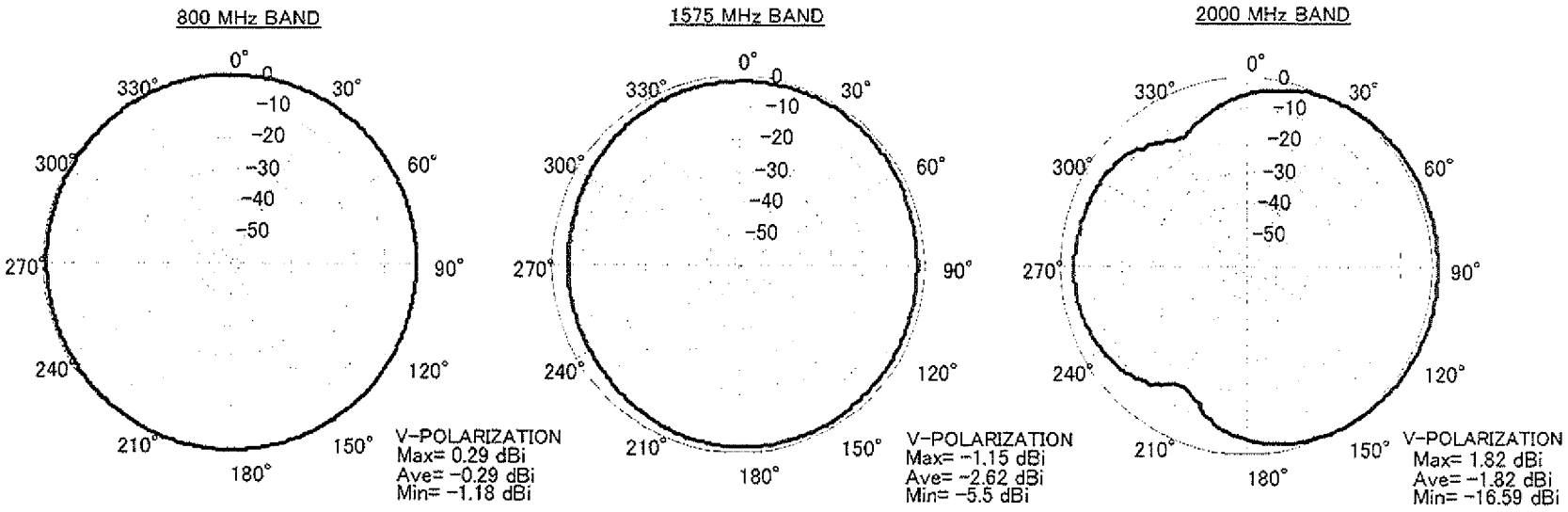
FIG. 8 is a graph illustrating the radiation pattern of an antenna device according to the present embodiment.

Next, a description will be given of the results of measurement of a radiation pattern at each resonance frequency using the practically manufactured antenna-device substrate and antenna device provided with the same of the present embodiment with reference to FIG. 8.

Note that the direction along which the first extension portion (E1) extends is defined as the X direction, the direction opposite to the direction along which the second extension portion (E2) extends is defined as the Y direction, and the vertical direction to the ground plane (GND) is defined as the Z direction. A vertical polarization to the Y-Z plane in this case was measured.

As the passive elements, the first passive element (P1): 2.0 nH, the second passive element (P2): 2.2 nH, the third passive element (P3): 1.5 nH, and the fourth passive element (P4): 5.6 nH were used where all the elements were inductors.

FIG. 8*a* shows a radiation pattern at the first resonance frequency (f1) of 800 MHz band, where the first resonance frequency (f1) was 878 MHz, the VSWR was 1.18, and the bandwidth (V.S.W.R≤3) was 89 MHz, Also, FIG. 8*b* shows a radiation pattern at the second resonance frequency (f2) of 1575 MHz band, where the second resonance frequency (f2) was 1571 MHz, the VSWR was 2.52, and the bandwidth (V.S.W.R≤3) was 32 MHz.

Furthermore, FIG. 8*c* shows a radiation pattern at the third resonance frequency (f3) of 2000 MHz band, where the third resonance frequency (f3) was 2054 MHz and the bandwidth (V.S.W.R≤3) was 235 MHz.

As can be seen from these radiation patterns, antenna characteristics having almost no directivity were obtained for 800 MHz band and 1575 MHz band, whereas antenna characteristics having directivity around 90-degree direction were obtained for 2000 MHz band.

The present invention is not limited to the aforementioned embodiment and various modifications may be made without departing the spirit of the present invention.

For example, when the antenna installation area is small, the elements may be patterned not only on the surface of a substrate main body but also on the rear surface thereof or in the inner layer of a multilayer substrate.

Figure 9:
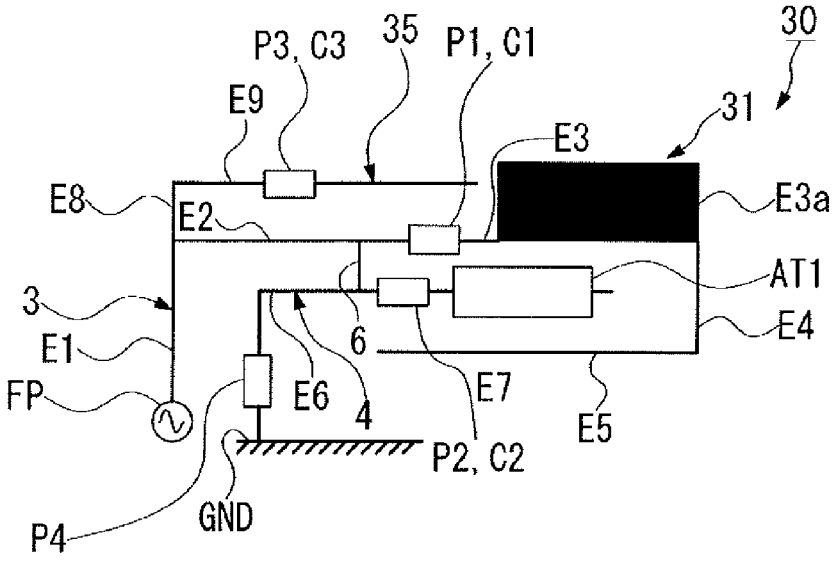
FIG. 9 is a wiring diagram illustrating an antenna-device substrate and an antenna device according to another example of the present embodiment.

As another example of the embodiment, as shown in FIG. 9, an antenna-device substrate 31 in which a third element 35 is extended to longer length without using the second antenna element (AT2) and an antenna device 30 using the same may also be employed. In the antenna-device substrate 1 and the antenna device 10 as described with reference to FIG. 1, the length of the tip end of the third element 5 can be reduced by connecting the second antenna element (AT2) to the third element 5. Thus, the antenna-device substrate 1 and the antenna device 10 are preferred in the case where the antenna installation area is small. Also, in the antenna-device substrate 1 and the antenna device 10, a greater floating capacitance (Cg) can be obtained by employing the second antenna element (AT2). In contrast, when a wide antenna installation area can, be ensured, a desired antenna performance can be obtained by extending the third element 35 without using the second antenna element (AT2) as shown in another example of the embodiment in FIG. 9.

In this manner, in another example of the embodiment, the number of components of the antenna element can be reduced, resulting in low cost production. Thus, the antenna-device substrate 1 and the antenna device 10 described in the above embodiment are preferred for the design with focus on size reduction, whereas the antenna-device substrate 31 and the antenna device 30 of another example of the embodiment are preferred for the design with focus on cost reduction.

REFERENCE NUMERALS

1, 31: substrate for antenna device, 2: substrate main body, 3: first element, 4: second element, 5, 35: third element, 6: short part, 10, 30: antenna device, AT1: first antenna element, AT2: second antenna element, C1: first connector, C2: second connector, C3: third connector, E1: first extension portion, E2: second extension portion, E3: third extension portion, E3*a*: wide portion, E4: fourth extension portion, E5: fifth extension portion, E6: sixth extension portion, E7: seventh extension portion, E8: eighth extension portion, E9: ninth extension portion, GND: ground plane, P1: first passive element, P2: second passive element, P3: third passive element, P4: fourth passive element, FP: feed point

What is claimed is:

1. An antenna-device substrate comprising:

an insulating substrate main body;

a ground plane, a first element, a second element, and a third element each of which is in the form of metal foil and has been patterned on the surface of the substrate main body; and a short part connecting a part of the first element and a part of the second element, wherein the first element is provided with a feed point at the base end and extends comprising a first connector of which the intermediate part is connectable to a first passive element, the second element is connected to the ground plane at the base end and is provided with a first antenna element of a dielectric antenna at the tip end, and extends comprising a second connector to which a second passive element is connectable and a fourth passive element connected closer to the ground plane side than the second connector, the third element extends comprising a third connector to which a third passive element is connectable and the base end of the third element is connected closer to the base end side than the first connector of the first element, the short part is connected between the position closer to the base end side than the first connector of the first element and the portion from the second connector to the fourth passive element of the second element, and the first element extends with a gap provided between the first element and each of the second element, the third element, and the ground plane such that a floating capacitance can be generated between the first element and each of the second element, the third element, and the ground plane.

2. The antenna-device substrate according to claim 1, wherein the first element comprises a first extension portion extending from the feed point provided on the ground plane side to a direction away from the ground plane, a second extension portion extending from the tip end of the first extension portion to the short part which extends in a direction along the ground plane, a third extension portion extending from the tip end of the second extension portion to a direction along the ground plane, a fourth extension portion extending from the tip end of the third extension portion toward the ground plane, and a fifth extension portion extending from the tip end of the fourth extension portion toward the first extension portion along the ground plane, the second element comprises a sixth extension portion extending from the short part to the base end side and a seventh extension portion extending from the short part to the tip end side and the tip end side of the second element is arranged along a space between the third extension portion and the fifth extension portion, and the third element comprises an eighth extension portion extending from the first extension portion in the same direction as the first extension portion and a ninth extension portion extending from the eighth extension portion along the second extension portion.

3. The antenna-device substrate according to claim 2, wherein a position at which the short part is connected is changeable in an extending direction between the second extension portion and the tip end side of the second element which are parallel to one another.

4. The antenna-device substrate according to claim 2, wherein the third extension portion provided in the first element comprises a wide portion which is formed facing to the tip end of the third element such that a floating capacitance can be generated therebetween.

5. The antenna-device substrate according to claim 1, wherein the second antenna element of the dielectric antenna is provided at the tip end of the third element.

6. An antenna device comprising:

the antenna-device substrate according to claim 1, wherein the first passive element, the second passive element, and the third passive element are connected to the first connector, the second connector, and the third connector corresponding thereto respectively.

7. An antenna device comprising:

the antenna-device substrate according to claim 1, wherein the second passive element is connected to the second connector, and either one of the first passive element or the third passive element is connected to the first connector or the third connector corresponding thereto respectively.

8. An antenna device comprising:

the antenna-device substrate according to claim 5, wherein the first passive element, the second passive element, and the third passive element are connected to the first connector, the second connector, and the third connector corresponding thereto respectively.

9. An antenna device comprising:

the antenna-device substrate according to claim 5, wherein the second passive element is connected to the second connector, and either one of the first passive element or the third passive element is connected to the first connector or the third connector corresponding thereto respectively.

* * * * *